United States Patent [19]

Kimura et al.

[11] Patent Number: 4,491,005

[45] Date of Patent: Jan. 1, 1985

[54] ROLLING MILL

[75] Inventors: Tomoaki Kimura, Hitachi; Keiji Miyakozawa, Katsuta, both of Japan

[73] Assignee: Hitachi, Ltd., Tokyo, Japan

[21] Appl. No.: 384,557

[22] Filed: Jun. 3, 1982

[30] Foreign Application Priority Data

Jun. 3, 1981 [JP] Japan ..... 56/86241

[51] Int. Cl.[3] ..... B21B 27/10; B21B 31/18; B21B 29/00

[52] U.S. Cl. ..... 72/201; 72/243; 72/247

[58] Field of Search ..... 72/243, 241, 245, 247, 72/201

[56] References Cited

U.S. PATENT DOCUMENTS

| | | | |
|---|---|---|---|
| 3,818,743 | 6/1974 | Kajiwara et al. | 72/243 |
| 3,857,268 | 12/1974 | Kajiwaka | 72/245 X |
| 3,943,742 | 3/1976 | Kajiwara et al. | 72/247 |
| 4,369,646 | 1/1983 | Kajiwara | 72/243 |

FOREIGN PATENT DOCUMENTS

| | | | |
|---|---|---|---|
| 136207 | 9/1981 | Japan | 72/243 |

*Primary Examiner*—Francis S. Husar
*Assistant Examiner*—Steven B. Katz
*Attorney, Agent, or Firm*—Beall Law Offices

[57] ABSTRACT

A rolling mill comprises working rolls, backup rolls, beams disposed along the rolls for supporting the working rolls, and supports mounted on the housing of the rolling mill for slidably supporting the beams. The beams have roll benders engaging with metal chocks of the working rolls and are moved axially by actuators that are disposed separately, so as to control the shape of a rolled material. The support has a central projection extending beyond the position of the roll bender and supporting symmetrically the bending force without providing a moment about the axis of the beam. The beam, further, is provided with apparatus inside for cooling the work rolls.

16 Claims, 4 Drawing Figures

ROLLING MILL

This invention relates to a rolling mill for rolling and producing a thin rolled steel sheet, and more particularly to a moving working roll type four-high rolling mill which can remarkably improve the cross-sectional shape of the thin sheet in rolling the sheet.

It is known that a four-high rolling mill in which upper and lower working rolls move in the axial direction so as to cross one another is effective in correcting the shape or improving the sectional profile of a rolled sheet. In order to improve the shape of the rolled sheet or improve its sectional profile in the abovementioned rolling mill, it is necessary to secure proper axial movement of the upper and lower working rolls and to apply a force to bend a roll axis, or so-called "roll bender" force, to metal chocks. The working roll bender also has the role of pushing the working rolls against backup rolls to transmit the driving turning force to the backup rolls when rolling is not effected such as during a rolling pass.

This roll bender force is applied by exerting a force between the working roll system and a different system. A hydraulic cylinder is generally used as the roll bender. When the force is between two as above, systems, moving the working rolls invites damage to the hydraulic cylinder, and in practice the working rolls can be moved only when the roll bender force is not applied, that is, when the hydraulic cylinder is released. Unless the roll bender force is applied, however, the driving force during the rotation of the working rolls is not transmitted to the backup rolls so that the speed of rotation of the backup rolls drops remarkably or they stop completely. For these reasons, movement of the working rolls is effected only when the rotation of the rolls is stopped, thus reducing the rolling efficiency.

A four-high rolling mill similar to the above is disclosed in Japanese patent publication No. 51-7635.

A six-high rolling mill, in which intermediate rolls are shifted in an axial direction will roll bender force being applied, is described in U.S. Pat. No. 4,369,646 "Rolling mill and method for rolling a sheet material" assigned to the same assignee as this application.

An object of the invention is to provide a rolling mill which can move the working rolls in an axial direction when the roll bender is made to act, too.

Another object of the invention is to provide a four-high rolling mill which is simple in construction and can move the working rolls in an axial direction without influencing a thickness control system.

Another object of the invention is to provide a four-high rolling mill with a compact cooling means.

The invention resides in that beams, disposed in the axial direction of the rolls inside the housing of a rolling mill and having hydraulic cylinder means disposed in the proximity of the metal chocks of the working rolls are moved axially by actuators that are disposed separately, and supports mounted on the housing support so as to wrap the beams, with the central projections of the supports extending toward the working rolls beyond the positions of the hydraulic cylinder means as roll benders.

Further, the beams are disposed so as to extend over the entire length of the working rolls. A hollow is formed at a necessary portion of the beam, a large number of nozzles are disposed at the hollow, and a liquid for cooling or lubricating the working rolls is pressure-fed to the hollow and sprayed on the working rolls from the nozzle.

This arrangement replaces a header or the like that has been conventionally used for cooling the working rolls and the space thus saved is used for passing the beams through the housing.

The other features, advantages of the invention will be apparent from the description of the preferred embodiment in reference to the drawings in which.

Hereinafter, a preferred embodiment of the invention will be described with reference to FIGS. 1 through 4.

Figure 1:
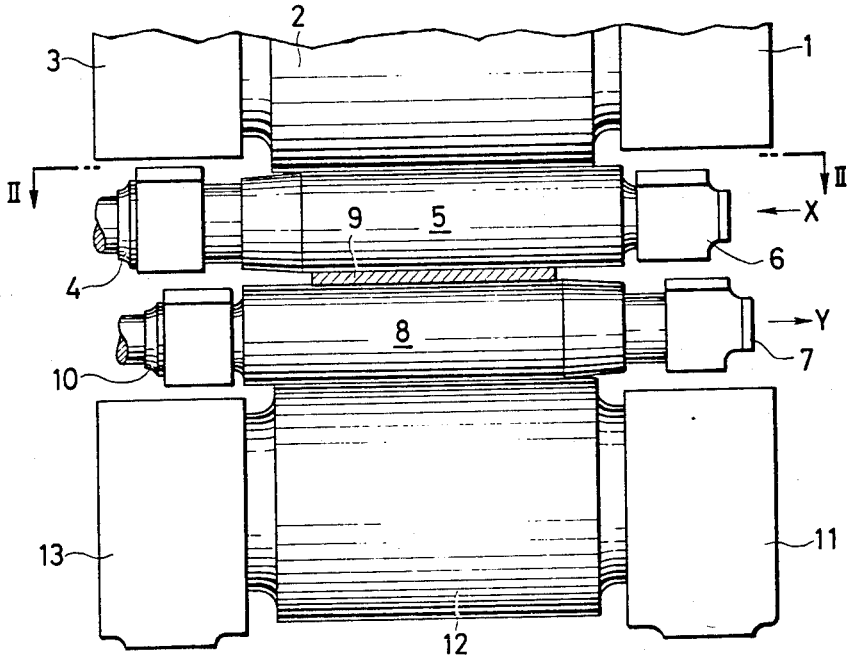
FIG. 1 is a schematic view of the moving working roll type rolling mill in accordance with an embodiment of the present invention.

FIG. 1 illustrates a rolling mill with axially movable working rolls. In this rolling mill, a working roll 5 supported by metal chocks 4, 6 and a working roll 8 supported by metal chocks 7, 10 can be moved in the directions represented by arrows X and Y, or in the opposite directions.

It is known that a material to be rolled can be rolled in an ideal form if the working rolls are moved and set so that the roll shoulders of the upper and lower working rolls 5, 8 substantially conform with the ends of the sheet width of the material 9 to be rolled.

These working rolls are moved while kept in contact with a backup roll 2 supported by metal chocks 1, 3 and a backup roll 12 supported by the metal chocks 11, 13, respectively. The backup rolls support the reaction to rolling during the rolling operation.

Though not shown in the drawings, the working rolls are driven by driving apparatus comprising motors or the like and this driving force is transmitted to the material 9 to be rolled or to the backup rolls 2, 12.

Figure 2:
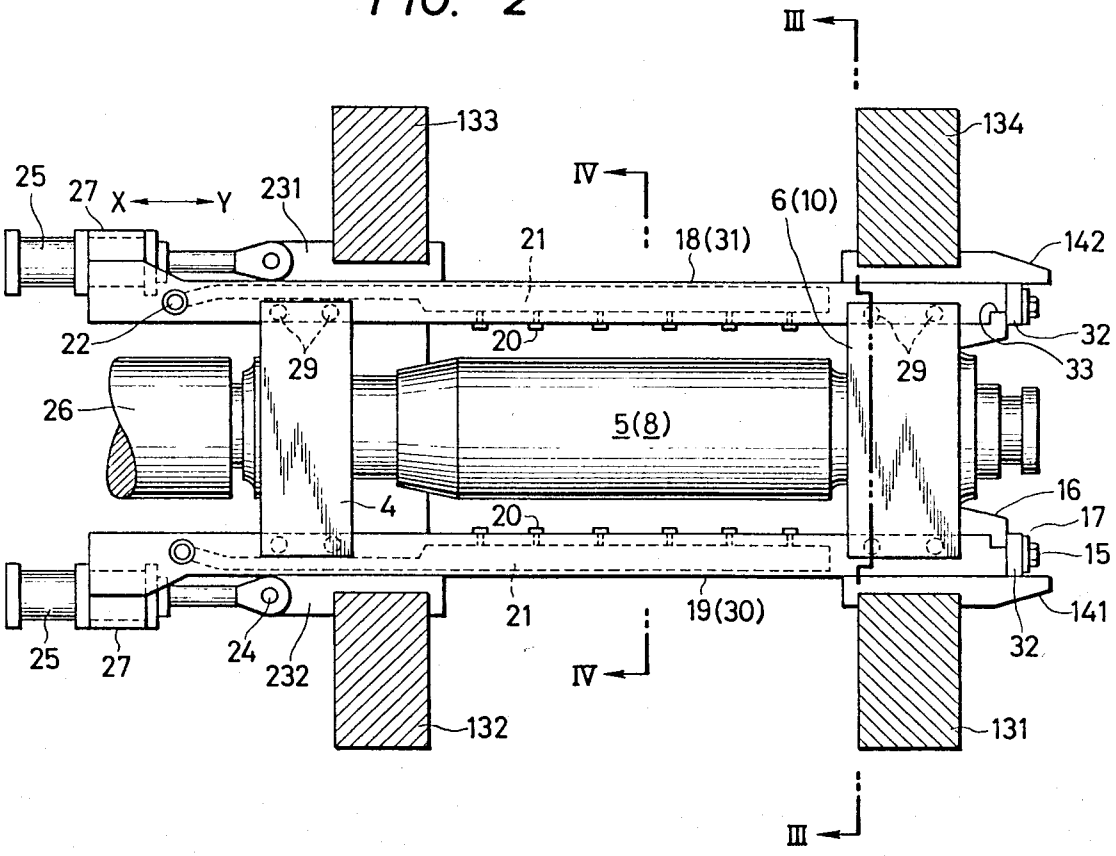
FIG. 2 is a sectional view taken along line II—II of FIG. 1.

FIG. 2 illustrates an example of the working roll moving mechanism of the invention.

In FIG. 2, the working roll 5 is supported by the metal chocks 4, 6 and is driven by the driving apparatus, not shown, through a coupling 26. This working roll 5 is supported on both sides by beams 18, 19 that are guided and supported by supports 141, 142, that are secured to stands 131, 134, and by supports 231, 232, that are secured to stands 132, 133, respectively. The working roll 8 also is supported by the stands 131, 134, 132, 133 through beams 30, 31 and the supports 141, 142, 231, 232, in the same way as the working roll 5. The stands 131 to 134 forms a roll housing.

Figure 3:
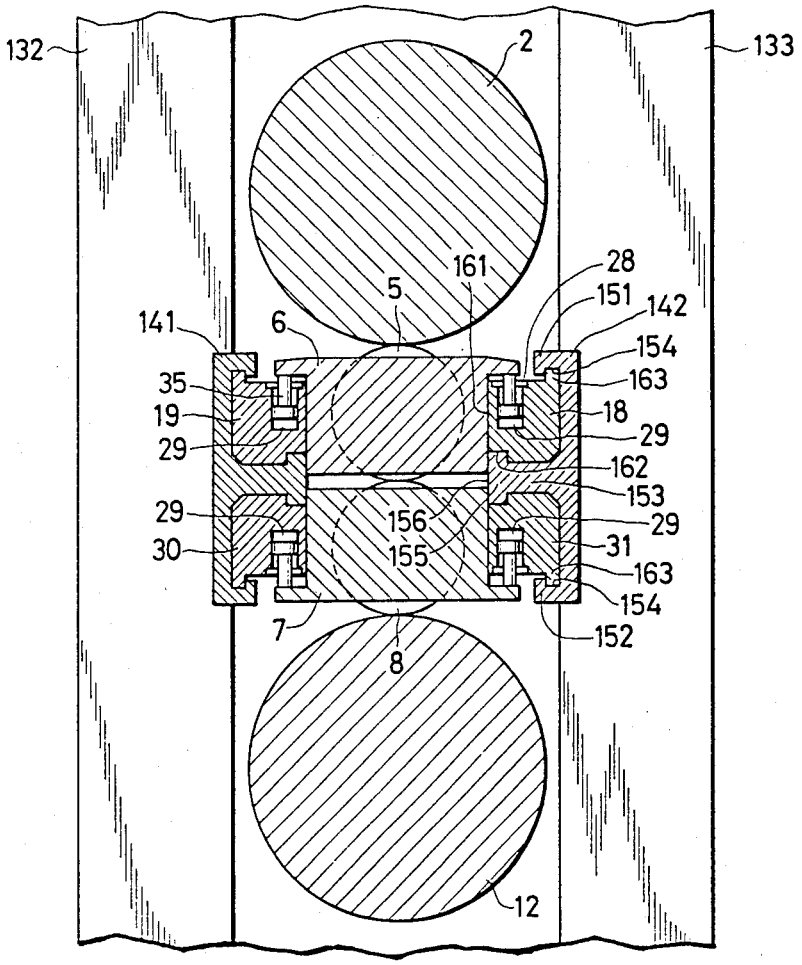
FIG. 3 is a sectional view taken along line III—III of FIG. 1.

As shown in FIG. 3, each of the supports 141, 142 has an upper projection 151, a lower projection 152 spaced vertically from the upper projection 151, and a central projection 153 at an equidistant position from the upper and lower projections 151, 152. All the projections extend toward the working rolls 5, 8. Each of the upper and lower projections 151, 152 is formed with a recess 154 opened to the central projection 153. The central projection has an end 155 a little projecting upward and downward so that a pair of spaces are formed in which the beams 18, 31 are slidably disposed. The end 155 has a vertical flat face 156 facing the working rolls 5, 8. In each of the beams 18, 31, there are formed a vertical flat face 161 facing the working roll 5, 8, a recess 162 formed on a bottom contacting with the central projection 153 engaging with the projection of the central projection 153, and a small projection 163 inserted in the recess 154 of the upper or lower projection 151, 152. The vertical flat faces 161 of the beam 18, 31 are aligned with the vertical flat face 156 of the support 141 so that a guide face is formed for the metal chocks 6, 7.

The supports 141, 142 that guide and support the beams 18, 19, 30, 31 are produced with a construction which wraps the beams.

In the example shown in FIG. 3 these supports 141, 142 are formed as one body, but they may, of course, be formed separately.

Hydraulic cylinders 29 for roll benders which comprises cylinders, pistons 35, covers 28 and so forth are disposed between the metal chocks 6, 7, (4, 10) and the beams 18, 19, 30, 31 . Only one of the cylinders is explained because the others are similar to the one. The cylinder 29 is disposed in a recess in the beam 18, and the piston 35 is inserted in the cylinder. The piston 35 has a rod extending through the hole of the cover 28 and supporting a portion laterally projecting over the beam 18.

Thus constructed roll benders are arranged symmetically of the axes of the central projections 153, and within the central projections 153 so that the reactions of roll bending force applied to the working rolls cancel each other and do not produce any rotating moment about the axis of the beams. Therefore, the metal chocks 6, 8 can move smoothly in the vertical direction according to an automatic thickness control apparatus (not shown).

Referring back to FIG. 2, actuator cylinders 25 are fitted at one end to the beams 18, 19 by covers 27, respectively. At the other end, the cylinders 25 are connected by pins 24 to the fixed supports 231 and 232, respectively. The cylinders 25, covers 27, pins 24 and supports 231, 232 are on the opposite sides of the driving apparatus to provide therebetween space enough to accommodate the coupling 26 and the roll driving apparatus. Therefore, the couplings 26, etc are easy to be connected or disconnected. Further, even if the coupling, for example, is disconnected from the working roll and displaced somewhat from the regular position by some reasons, the beams 18, 19, 30, 31 are not damaged by a contact with the coupling 26.

The working roll 5 is connected to the beams 18, 19 with an arm 16, which extends from the metal chock 6, clamped and fixed to a slit portion 33 of the beams by plate 32 via bolt 15 and washer 17. This plate 32 may of course be movably connected to the cylinder.

The working roll 5 can be moved in the axial direction of the roll by axially moving the beams 18, 19 with the cylinders 25 being operated to exert working force. The working roll 8 also can be moved in the manner similar to that of the working roll 5 in the opposite direction.

In the axially moving operation of the working rolls 4, 8, an axial force exerted by the cylinders 25 provides a rotating moment of each of the beams 18, 19, because there is a distance between the axis of each of the cylinders 25 and the respective beam axis. When the axial force is in the direction X, a force that is directed to compress the metal chock 4 is produced, and when the axial force is in the direction Y, a force that is directed to compress the metal chock 6 is produced. These forces, however, are not applied to actually compress the metal chock 4, 6, because the supports 141, 142 have constructions which wrap around the beams 18, 19, respectively, and thereby restrict the displacement of the beams toward the metal chocks 4, 6. Therefore, a proper bearing gap is kept between the metal chock 5, 6 and the guide vertical flat faces 161 and 156, whereby the working rolls 5, 8 can be moved smoothly in the vertical direction during roll bending without binding.

Figure 4:
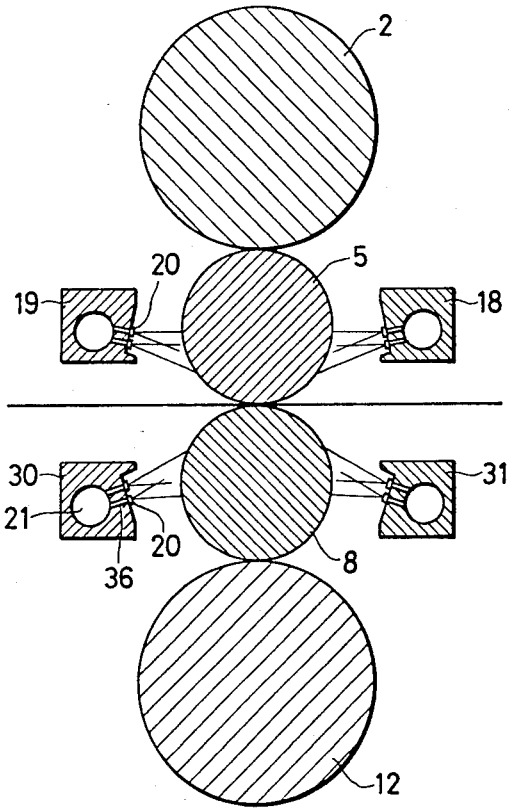
FIG. 4 is a sectional view taken along line IV—IV of FIG. 2.

Referring to FIG. 4 in addition to FIG. 2.

Hollow water introduction bores 21, indicated by dotted lines, are bored in the centers of beams 18, 19, 30, 31 and a liquid is pressure-fed into these bores from feed water holes 22. The liquid such as cooling water is sprayed on the working rolls 5, 8 from a large number of nozzles 20 communicating with the bores 21 through thin passages 36 during the rolling operation. The nozzles 20 are disposed near the portion of the working rolls contacting with the material to be rolled so that heat conducted to the working rolls can be removed effectively, that is, before the heat reaches to deep portions of the working rolls.

In the construction of the invention, the working roll 5 supported by the beams 18, 19 and the metal chock 6 and the working roll 8 supported by the beams 30, 31 and the metal chock 7 move together with each other and the bender force applied to the working rolls is applied by the cylinders 29 incorporated in the beams. Thus, even when the bender force is applied to the working rolls during their movement, the piston 35 of each cylinder 29 is not broken and the force is also applied to the backup rolls 2, 12 from the cylinders 29 through the working rolls 5, 8. According to this construction, preparation can be made for procedures such as the movement of the working rolls and the like until subsequent rolling without reducing the speed of rotation of the backup rolls even when moving the working rolls.

As shown in FIG. 2, the beams 18, 19 can also cool the working rolls 5. Accordingly, the invention can provide a compact moving working roll type rolling mill and can provide a large effect in improving the efficiency of rolling work.

What is claimed is:

1. A rolling mill comprising:

a roll housing;

a pair of working rolls provided with metal chocks at the ends and brought into contact with a material to be rolled;

a pair of backup rolls, mounted on said roll housing by metal chocks provided at the ends for supporting the said respective working rolls;

a plurality of beams extending along the axes of said working rolls and disposed in juxtaposition with said working rolls;

a plurality of supports mounted on said roll housing at portions facing said metal chock for said working rolls for axially slidably supporting said beam, each of said supports having a central projection projecting horizontally toward said working rolls and mounting thereon said beams, said central projection having upper and lower projections at the end facing said metal chock for restricting horizontal movement of said beam;

a plurality of roll benders, provided on said beams within regions of said central projection and said roll benders being engaged with parts of said metal chocks of said working rolls, said roll benders being disposed on said beams symmetrically with respect to said central projections so that forces applied to said beams by said benders are canceled through said central projections; and a plurality of independent actuators disposed in adjacent relation with said beams and connected to said housing and said beams, at the side portions where driving means for said working rolls are disposed, for moving said beams in the axial direction, respectively, whereby said working rolls are moved axially through axial movement of said beams by said actuators.

2. The rolling mill as defined in claim 1, wherein said beams and said supports have vertical flat faces facing said metal chocks of said working rolls, said vertical flat faces of said beams being aligned with ones of said supports so that guide means for guiding vertical movement of said metal chocks of said working rolls are provided.

3. The rolling mill as defined in claim 1, wherein said beams each have therein passages for coolant communicating with a plurality of nozzles opened toward said working rolls.

4. The rolling mill as defined in claim 3, wherein said beams have coolant entrances to said passages near said actuators.

5. A rolling mill comprising:

a roll housing;

a pair of parallel axis working rolls provided with metal chocks at the opposite axial ends;

a pair of parallel axis back-up rolls, mounted on said roll housing by metal chocks provided at the opposite axial ends, for supporting respective ones of said working rolls;

means operatively connected to said work rolls for adjusting the spacing between said working rolls and to bring the working rolls into contact with the material to be rolled;

at least two beams extending axially parallel to and on opposite sides of one of said working rolls; the opposite axial ends of each beam having means for supporting respective ones of said metal chocks for said one working roll, and including roll benders providing radial forces between said beams and chocks for bending said one working roll to control the contour of the material to be rolled;

means mounting the opposite axial ends of said beams on said roll housing for movement of said beams together with said one working roll and its associated chocks axially relative to said roll housing, and including a slide bearing in said housing and wrapping around each beam so as to prevent any translation movement of said beam in a plane perpendicular to the axes of said working rolls and further to prevent rotational movement of said beam about its central axis parallel to the axis of said one working roll to neutralize the forces provided by said roll benders and permit axial movement of said beams when said roll benders are actuated; and independent actuator means connected between said housing and said beams for driving said beams and one working roll axially.

6. The rolling mill as defined in claim 5, including two further beams, further means for supporting, means for mounting and indepedent actuator means associated with the other of said working rolls in mirror image and substantially identical to the respective means of said one working roll, so that forces and movements about respective beam axes as produced on said beams by said roll benders of one working roll will be directly opposed and cancelled substantially by those of the other working roll.

7. The rolling mill as defined in claim 6, wherein said rolls are vertically stacked, and said means supporting include two slide bearngs symmetrically arranged in a horizontal plane passing through the gap between said working rolls, wherein the beams for the upper working roll are horizontally spaced apart and the beams for the lower working roll are horizontally spaced apart in opposed horizontal pairs and opposed vertical pairs symmetrical with respect to the gap between said working rolls;

each bearing being integral, rigidly mounted on said roll housing, supporting both adjacent ends of one vertical pair of beams, respectively, and being configured in cross section perpendicular to said roll axes so as to include a central inwardly extending T-shaped projection; the projection having its innermost surface engaging the outermost surface of both chocks for one end of both working rolls; a vertically extending portion parallel to, outwardly spaced from, and of greater vertical extent than said surface, with the horizontal portion of said T-shaped central projection extending therebetween; and upper and lower projections extending inwardly from the uppermost and lowermost ends of said vertically extending portion and then extending toward each other with small projections to form respective recesses;

each beam having a configuration and cross section perpendicular to said axes so as to completely engage the inner surfaces of said bearing forming said recesses, said vertically extending portion and said T-shaped central projection, and further having a flat innermost surface coextensive with the innermost surface of said T-shaped projection and engaging with a respective chock of the respective working roll; and said roll benders including piston and cylinder means extending directly between respective beams and chocks for said working rolls.

8. The rolling mill as defined in claim 6, wherein said rolls are vertically stacked, and said means supporting include two slide bearing symmetrically arranged in a horizontal plane passing through the gap between said working rolls, wherein the beams for the upper working roll are horizontally spaced apart and the beams for the lower working roll are horizontally spaced apart in opposed horizontal pairs and opposed vertical pairs symmetrical with respect to the gap between said working rolls;

each bearing being integral, rigidly mounted on said roll housing, supporting both adjacent ends of one vertical pair of beams, respectively, and being configured in cross section perpendicular to said roll axes so as to include a central inwardly extending projection; the projection having its innermost surface engaging the outermost surface of both chocks for one end of both working rolls; a vertically extending portion parallel to, outwardly spaced from, and of greater vertical extent than said surface, with the horizontal portion of said central projection extending therebetween;

each beam having a configuration and cross section perpendicular to said axes so as to completely engage the inner surfaces of said bearing forming said recesses, said vertically extending portion and said central projection; and said roll benders including piston and cylinder means extending directly between respective beams and chocks for said working rolls.

9. The rolling mill as defined in claim 6, wherein said rolls are vertically stacked, and said means supporting including two slide bearings symmetrically arranged in a horizontal plane passing through the gap between said working rolls, wherein the beams for the upper working roll are horizontally spaced apart and the beams for the lower working roll are horizontally spaced apart in opposed horizontal pairs and opposed vertical pairs symmetrical with respect to the gap between said working rolls;

each bearing being integral, rigidly mounted on said roll housing, supporting both adjacent ends of one vertical pair of beams, respectively, and being coinfigured in cross section perpendicular to said roll axes so as to include a central inwardly extending projection; the projection having its innermost surface engaging the outermost surface of both chocks for one end of both working rolls; a vertically extending portion parallel to, outwardly spaced from, and of greater vertical extent than said surface, with the horizontal portion of said central projection extending therebetween; and upper and lower projections extending inwardly from the uppermost and lowermost ends of said vertically extending portion to form respective recesses;

each beam having a configuration and cross section perpendicular to said axes so as to completely engage the inner surfaces of said bearing forming said recesses, and vertically extending portion and said central porjection, and further having a flat innermost surface coextensive with the innermost surface of said central projection and engaging with a respective chock of the respective working roll; and said roll benders including piston and cylinder means extending directly between respective beams and chocks for said working rolls.

10. A rolling mill comprising:

a roll housing;

a pair of parallel axis working rolls provided with metal chocks at the opposite axial ends;

a pair of parallel axis back-up rolls, mounted on said roll housing by metal chocks provided at the opposite axial ends, for supporting respective ones of said working rolls;

means operatively connected to said work rolls for adjusting the spacing between said working rolls and to bring the working rolls into contact with the material to be rolled;

at least two beams extending axially parallel to and on opposite sides of one of said working rolls; the opposite axial ends of each beam having means for supporting respective ones of said metal chocks for said one working roll, and including roll benders providing radial forces between said beams and chocks for bending said one working roll to control the contour of the material to be rolled;

means mounting the opposite axial ends of said beams on said roll housing for movement of said beams together with said one working roll and its associated chocks axially relative to said roll housing;

cooling means mounted on and axially movable with each of said beams for spraying cooling liquid on said working rolls near the portion of the working rolls contacting with the material to be rolled; and actuator means connected between said housing and said beams for driving said beams with said cooling means and said one working roll with its chocks together as a unit axially so that the relationship between said cooling means and said one working roll remains the same during said driving.

11. The rolling mill as defined in claim 10, including two further beams including roll benders, further means for supporting, means for mounting, cooling means and actuator means associated with the other of said working rolls in the mirror image and substantially identical to the respective beams and means of said one working roll, so that said cooling of said one working roll will be substantially the same as cooling of the other working roll.

12. The rolling mill as defined in claim 11, wherein each of said cooling means feeds cooling liquid under pressure axially along each beam and includes a plurality of spray nozzles fixedly spaced along each beam and aimed at the adjacent working roll.

13. A rolling mill comprising:

a roll housing;

a pair of parallel axis working rolls provided with metal chocks at the opposite axial ends;

a pair of parallel axis back-up rolls, mounted on said roll housing by metal chocks provided at the opposite axial ends, for supporting respective ones of said working rolls;

means operatively connected to said work rolls for adjusting the spacing between said working rolls and to bring the working rolls into contact with the material to be rolled;

two beams extending axially parallel to and on opposite sides of each of said working rolls; the opposite axial ends of each beam having means for supporting respective ones of said metal chocks for said working rolls, and including roll benders providing radial forces between each end of each of said beams and the adjacent chocks for bending said working rolls to control the contour of the material to be rolled;

means mounting the opposite axial ends of said beams on said roll housing for movement of said beams together with each of said working rolls and its associated chocks axially relative to said roll housing, and including four slide bearings in said housing, each respectively for the two adjacent ends of beams on the same side, said bearings each including a central projection extending between and engaging its adjacent beam ends so as to prevent any movement of said beam ends toward each other to neutralize the forces provided by said roll benders and permit axial movement of said beams when said roll benders are actuated by opposing the force of one roll bender directly by the force of the adjacent roll bender on the other side of their central projection; and independent actuator means connected between said housing and said beams for driving said beams, said chocks and said roll benders for each working roll axially.

14. The rolling mill as defined in claim 13, wherein said rolls are vertically stacked, and said means supporting include said slide bearings symmetrically arranged in a horizontal plane passing through the gap between said working rolls, wherein the beams for the upper working roll are horizontally spaced apart and the beams for the lower working roll are horizontally spaced apart in opposed horizontal pairs and opposed vertical pairs symmetrical with respect to the gap between said working rolls;

each bearing being integral, rigidly mounted on said roll housing, supporting both adjacent ends of one vertical pair of beams, respectively, and being configured in cross section perpendicular to said roll axes so that said central projection has an inwardly extending T-shape; the projection having its innermost surface engaging the outermost surface of both chocks for one end of both working rolls; a vertically extending portion parallel to, outwardly spaced from, and of greater vertical extent than said surface, with the horizontal portion of said T-shaped central projection extending therebetween; and upper and lower projections extending inwardly from the uppermost and lowermost ends of said vertically extending portion and then extending toward each other with small projections to form respective recesses;

each beam having a configuration and cross section perpendicular to said axes to as to completely engage the inner surfaces of said bearing forming said recesses, said vertically extending portion and said T-shaped central projection, and further having a flat innermost surface coextensive with the innermost surface of said T-shaped projection and engaging with a respective chock of the respective working roll; and said roll benders including piston and cylinder means extending directly between respective beams and chocks for said working rolls.

15. A rolling mill comprising:

a roll housing;

a pair of parallel axis working rolls provided with metal chocks at the opposite axial ends;

a pair of parallel axis back-up rolls, mounted on said roll housing by metal chocks provided at the opposite axial ends, for supporting respective ones of said working rolls;

means operatively connected to said work rolls for adjusting the spacing between said working rolls and to bring the working rolls into contact with the material to be rolled;

at least two beams extending axially parallel to, coplanar with and on opposite sides of one of side working rolls;

the opposite axial ends of each beam having means for supporting respective ones of said metal chocks for said one working roll, including a transverse slide bearing engagement between each chock and beam end providing movement of each chock relative to the beams on each side in a direction perpendicular to the plane;

said means for supporting including roll benders providing radial forces that are perpendicular to the plane and between said beams and chocks for producing said movement and thereby bending said one working roll to control the contour of the material to be rolled;

means mounting the opposite axial ends of said beams on said roll housing for movement of said beams together with said one working roll and its associated chocks axially relative to said roll housing, and including an axial slide bearing in said housing;

independent actuator means connected between said housing and said beams for driving said beams and one working roll axially, and thereby producing a moment in said beams that tends to bend one end of said beams together to clamp the chock between the beam ends with said transverse slide bearing engagement; and said axial slide bearing wrapping aroung each beam so as to prevent bending movement of said beams in the plane to neutralize the moments provided by said actuator means and permit transverse slide bearing movement of said chocks relative to said beams along said transverse slide bearing engagement when both said actuator means and said roll benders are actuated.

16. The rolling mill as defined in claim 15, including two further beams, further means for supporting, means for mounting and independent actuator means associated with the other of said working rolls in mirror image and substantially indentical to the respective means of said one working roll, so that forces and movements about respective beam axes as produced on said beams by said roll benders of one working roll will be directly opposed and cancelled substantially by those of the other working roll.

* * * * *

REEXAMINATION CERTIFICATE (1401st)

United States Patent [19] [11] B1 4,491,005

Kimura et al. [45] Certificate Issued Jan. 8, 1991

[54] ROLLING MILL

[75] Inventors: Tomoaki Kimura, Hitachi; Keiji Miyakozawa, Katsuta, both of Japan

[73] Assignee: Hitachi, Ltd., Tokyo, Japan

Reexamination Request:
No. 90/001,851, Sep. 27, 1989

Reexamination Certificate for:

| | |
|---|---|
| Patent No.: | **4,491,005** |
| Issued: | **Jan. 1, 1985** |
| Appl. No.: | **384,557** |
| Filed: | **Jun. 3, 1982** |

[30] Foreign Application Priority Data

Jun. 3, 1981 [JP] Japan ..... 56-86241

[51] Int. Cl.[5] ..... B21B 27/10; B21B 31/18; B21B 29/00

[52] U.S. Cl. ..... 72/201; 72/241.8

[58] Field of Search ..... 72/243, 247, 245, 241, 72/201, 237, 238, 239, 241.8

[56] References Cited

U.S. PATENT DOCUMENTS

| | | | |
|---|---|---|---|
| 3,818,743 | 6/1974 | Kijiwara | 72/243 |
| 3,857,268 | 12/1974 | Kajiwara | 72/247 |
| 3,943,742 | 3/1976 | Kajiwara | 72/247 |
| 4,369,646 | 1/1983 | Kajiwara | 72/243 |

FOREIGN PATENT DOCUMENTS

| | | | |
|---|---|---|---|
| 1101702 | 5/1981 | Canada . | |
| 10026903 | 1/1986 | European Pat. Off. . | |
| 2260256 | 6/1973 | Fed. Rep. of Germany . | |
| 2505324 | 8/1975 | Fed. Rep. of Germany . | |
| 12385 | 5/1975 | Japan . | |
| 53-012753 | 4/1978 | Japan . | |
| 54-083658 | 9/1979 | Japan . | |
| 30658 | 10/1979 | Japan | 72/247 |
| 54-115661 | 11/1979 | Japan . | |
| 55-024712 | 2/1980 | Japan . | |

OTHER PUBLICATIONS

Brochure "Numerisch gesteuerte GF-Drehmaschinen MDM-10 und MDM-14" by Georg Fischer, Schaffhausen, Switzerland, p. 3, published 1970.

Brochure "Numerisch gesteuerte GF-Drehmaschinen MDM-17" by Georg Fischer, Schaffhausen, Switzerland, p. 5, published 1970.

Journal Linde "Berichte aus Technik und Sissenschaft", No. 21/1966, p. 39, Fig. 4.

Journal "Werkstattechnik und Maschinenbau", p. 430, 41st year, Nov. 1951, No. 11, Figs. 11a and 11c.

Loewy Robertson "Vidifoil" Integrated Process Control for Foil Mills.

*Primary Examiner*—Daniel C. Crane

[57] ABSTRACT

A rolling mill comprises working rolls, backup rolls, beams disposed along the rolls for supporting the working rolls, and supports mounted on the housing of the rolling mill for slidably supporting the beams. The beams have roll benders engaging with metal chocks of the working rolls and are moved axially by actuators that are disposed separately, so as to control the shape of a rolled material. The support has a central projection extending beyond the position of the roll bender and supporting symmetrically the bending force without providing a moment about the axis of the beam. The beam, further, is provided with apparatus inside for cooling the work rolls.

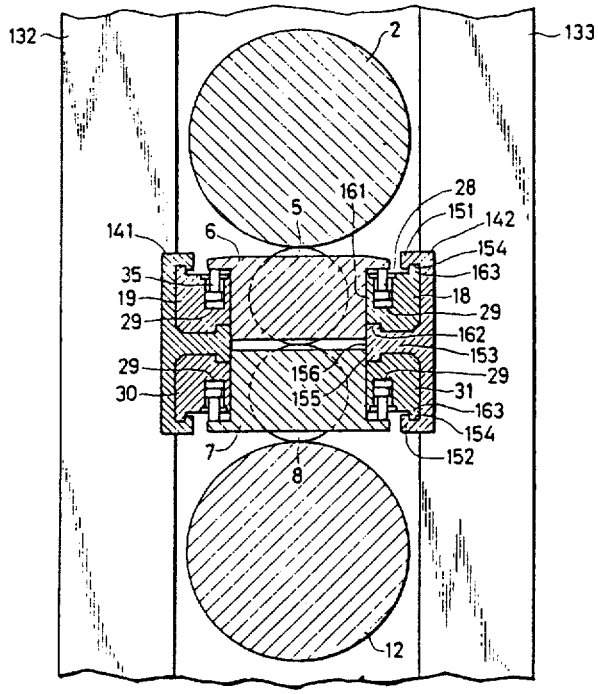

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 10–12 is confirmed.

Claim 6 is cancelled.

Claims 1, 2, 5, 7, 8, 9, 13, 14 and 15 are determined to be patentable as amended.

Claims 3, 4 and 16, dependent on an amended claim, are determined to be patentable.

1. A rolling mill comprising:

a roll housing;

a pair of working rolls provided with metal chocks at the ends and brought into contact with a material to be rolled;

a pair of backup rolls, mounted on said roll housing by metal chocks provided at the ends for supporting the said respective working rolls;

a plurality of *independent* beams extending along the axes of said working rolls and disposed *on opposite sides of each of said working rolls* in juxtaposition with said working rolls, *respectively*;

a plurality of supports mounted on said roll housing at portions facing said metal chock for said working rolls for axially slidably supporting said [beam] *beams*, each of said supports having a central projection projecting horizontally toward said working rolls and mounting thereon said beams *and upper and lower projections spaced vertically from said central projection*, said central projection having upper and lower [projections] *projecting portions* at the end facing said metal chock *and each of said upper and lower projections having recesses such that said projecting portions and said recesses engage parts of said beams* for restricting horizontal movement of said [beam] *beams*;

a plurality of roll benders, provided on said beams [within regions] *and positioned wholly within a horizontally extending width* of said central projection and said roll benders being engaged with parts of said metal chocks of said working rolls, said roll benders being disposed on said beams symmetrically with respect to said central projections so that forces applied to said beams by said benders are canceled through said central projections; and a plurality of independent [actuators] *actuator cylinders* disposed *axially in parallel to and* in [adjacent relation] *juxtaposition* with said beams, and connected to said housing and *directly to* said beams, at the side portions where driving means for said working rolls are disposed, for moving said beams in the axial direction, respectively, whereby said working rolls are moved axially through axial movement of said beams by said actuators.

2. The rolling mill as defined in claim 1, wherein said beams and said supports have vertical flat faces facing said metal chocks of said working rolls, said vertical flat faces of said beams being aligned with ones of said *central projections of said* supports so that guide means for guiding vertical movement of said metal chocks of said working rolls are provided.

5. A rolling mill comprising:

a roll housing;

a pair of parallel axis working rolls provided with metal chocks at the opposite axial ends;

a pair of parallel axis back-up rolls, mounted on said roll housing by metal chocks provided at the opposite axial ends, for supporting respective ones of said working rolls;

means operatively connected to said work rolls for adjusting the spacing between said working rolls and to bring the working rolls into contact with the material to be rolled;

at least two *independent* beams extending axially parallel to and on opposite sides of [one] *each* of said working rolls; the opposite axial ends of each beam having means for supporting respective ones of said metal chocks for *each of* said [one] working [roll] *rolls*, and including roll benders providing radial forces between said beams and chocks for bending said [one] working [roll] *rolls* to control the contour of the material to be rolled;

means mounting the opposite axial ends of said beams on said roll housing for movement of said beams together with said [one] working [roll] *rolls* and [its] associated chocks axially relative to said roll housing, and including [a] slide [bearing] *bearings* in said housing [and] wrapping around each beam, *each of said bearings including a central projection extending between and engaging adjacent beam ends on the same side of said working rolls and further including upper and lower projections spaced vertically from said central projection each having recesses, such that said central projection and said recesses engage parts of said beams* so as to prevent any translation movement of *each* said beam in a plane perpendicular to the axes of said working rolls and further to prevent rotational movement of *each* said beam about its central axis parallel to the axis of said [one] working [roll] *rolls and said roll benders being positioned wholly within a horizontally extending width of said central projection* to neutralize the forces provided by said roll benders and permit axial movement of said beams when said roll benders are actuated; and independent actuator *cylinder* means connected [between] *to* said housing *at one end thereof* and *to* said beams *at the other end thereof to contact said beam directly* for driving said beams and [one] *said* working roll axially.

7. [The rolling mill as defined in claim 6,] *A rolling mill comprising:*

*a roll housing;*

*a pair of parallel axes working rolls provided with metal chocks at the opposite axial ends;*

*a pair of parallel axes back-up rolls, mounted on said roll housing by metal chocks provided at the opposite axial ends, for supporting respective ones of said working rolls;*

*means operatively connected to said working rolls for adjusting the spacing between said working rolls and to bring the working rolls into contact with the material to be rolled;*

*at least two beams extending axially parallel to and on opposite sides of one of said working rolls;*

*the opposite axial ends of each beam having means for supporting respective ones of said metal chocks for said one working roll, and including roll benders providing radial forces between said beams and chocks for bending said one working roll to control the contour of the material to be rolled;*

*means mounting the opposite axial ends of said means on said roll housing for movement of said beams together with said one working roll and its associated chocks axially relative to said roll housing, and including a slide bearing in said housing and wrapping around each beam so as to prevent any translation movement of said beam in a claim perpendicular to the axes of said working rolls and further to prevent rotational movement of said beam about its central axis parallel to the axis of said one working roll to neutralize the forces provided by said roll benders and permit axial movement of said beams when said roll benders are actuated;*

*independent actuator means connected between said housing and said beams for driving said beams and one working roll axially;*

*two further beams, further means for supporting, means for mounting and independent actuator means associated with the other of said working rolls in mirror image and substantially identical to the respective means of said one working roll, so that forces and movements about respective beam axes as produced on said beams by said roll benders of one working roll will be directly opposed and cancelled substantially by those of the other working roll,* wherein said rolls are vertically stacked, and said means supporting include two slide bearngs symmetrically arranged in a horizontal plane passing through the gap between said working rolls, wherein the beams for the upper working roll are horizontally spaced apart and the beams for the lower working roll are horizontally spaced apart in opposed horizontal pairs and opposed vertical pairs symmetrical with respect to the gap between said working rolls;

each bearing being integral, rigidly mounted on said roll housing, supporting both adjacent ends of one vertical pair of beams, respectively, and being configured in cross section perpendicular to said roll axes so as to include a central inwardly extending T-shaped projection; the projection having its innermost surface engaging the outermost surface of both chocks for one end of both working rolls; a vertically extending portion parallel to, outwardly spaced from, and of greater vertical extent than said surface, with the horizontal portion of said T-shaped central projection extending therebetween; and upper and lower projections extending inwardly from the uppermost and lowermost ends of said vertically extending portion and then extending toward each other with small projections to form respective recesses;

each beam having a configuration and cross section perpendicular to said axes so as to completely engage the inner surfaces of said bearing forming said recesses, said vertically extending portion and said T-shaped central projection, and further having a flat innermost surface coextensive with the innermost surface of said T-shaped projection and engaging with a respective chock of the respective working roll; and said roll benders including piston and cylinder means extending directly between respective beams and chocks for said working rolls.

8. [The rolling mill as defined in claim 6,] *A rolling mill comprising:*

*a roll housing;*

*a pair of parallel axes working rolls provided with metal chocks at the opposite axial ends;*

*a pair of parallel axes back-up rolls, mounted on said roll housing by metal chocks provided at the opposite axial ends, for supporting respective ones of said working rolls;*

*means operatively connected to said working rolls for adjusting the spacing between said working rolls and to bring the working rolls into contact with the material to be rolled;*

*at least two beams extending axially parallel to and on opposite sides of one of said working rolls;*

*the opposite axial ends of each beam having means for supporting respective ones of said metal chocks for said one working roll, and including roll benders providing radial forces between said beams and chocks for bending said one working roll to control the contour of the material to be rolled;*

*means mounting the opposite axial ends of said means on said roll housing for movement of said beams together with said one working roll and its associated chocks axially relative to said roll housing, and including a slide bearing in said housing and wrapping around each beam so as to prevent any translation movement of said beam in a claim perpendicular to the axes of said working rolls and further to prevent rotational movement of said beam about its central axis parallel to the axis of said one working roll to neutralize the forces provided by said roll benders and permit axial movement of said beams when said roll benders are actuated;*

*independent actuator means connected between said housing and said beams for driving said beams and one working roll axially;*

*two further beams, further means for supporting, means for mounting and independent actuator means associated with the other of said working rolls in mirror image and substantially identical to the respective means of said one working roll, so that forces and movements about respective beam axes as produced on said beams by said roll benders of one working roll will be directly opposed and cancelled substantially by those of the other working roll,* wherein said rolls are vertically stacked, and said means supporting include two slide bearing symmetrically arranged in a horizontal plane passing through the gap between said working rolls, wherein the beams for the upper working roll are horizontally spaced apart and the beams for the lower working roll are horizontally spaced apart in opposed horizontal pairs and opposed vertical pairs symmetrical with respect to the gap between said working rolls;

each bearing being integral, rigidly mounted on said roll housing, supporting both adjacent ends of one vertical pair of beams, respectively, and being configured in cross section perpendicular to said roll axes so as to include a central inwardly extending projection; the projection having its innermost surface engaging the outermost surface of both chocks for one end of both working rolls; a vertically extending portion parallel to, outwardly spaced from, and of greater vertical extent than said surface, with the horizontal portion of said central projection extending therebetween;

each beam having a configuration and cross section perpendicular to said axes so as to completely engage the inner surfaces of said bearing forming said recesses, said vertically extending portion and said central projection; and said roll benders including piston and cylinder means extending directly between respective beams and chocks for said working rolls.

9. [The rolling mill as defined in claim 6,] *A rolling mill comprising:*

*a roll housing;*

*a pair of parallel axes working rolls provided with metal chocks at the opposite axial ends;*

*a pair of parallel axes back-up rolls, mounted on said roll housing by metal chocks provided at the opposite axial ends, for supporting respective ones of said working rolls;*

*means operatively connected to said working rolls for adjusting the spacing between said working rolls and to bring the working rolls into contact with the material to be rolled;*

*at least two beams extending axially parallel to and on opposite sides of one of said working rolls;*

*the opposite axial ends of each beam having means for supporting respective ones of said metal chocks for said one working roll, and including roll benders providing radial forces between said beams and chocks for bending said one working roll to control the contour of the material to be rolled;*

*means mounting the opposite axial ends of said means on said roll housing for movement of said beams together with said one working roll and its associated chocks axially relative to said roll housing, and including a slide bearing in said housing and wrapping around each beam so as to prevent any translation movement of said beam in a claim perpendicular to the axes of said working rolls and further to prevent rotational movement of said beam about its central axis parallel to the axis of said one working roll to neutralize the forces provided by said roll benders and permit axial movement of said beams when said roll benders are actuated;*

*independent actuator means connected between said housing and said beams for driving said beams and one working roll axially;*

*two further beams, further means for supporting, means for mounting and independent actuator means associated with the other of said working rolls in mirror image and substantially identical to the respective means of said one working roll, so that forces and movements about respective beam axes as produced on said beams by said roll benders of one working roll will be directly opposed and cancelled substantially by those of the other working roll,* wherein said rolls are vertically stacked, and said means supporting including two slide bearings symmetrically arranged in a horizontal plane passing through the gap between said working rolls, wherein the beams for the upper working roll are horizontally spaced apart and the beams for the lower working roll are horizontally spaced apart in opposed horizontal pairs and opposed vertical pairs symmetrical with respect to the gap between said working rolls;

each bearing being integral, ridigly mounted on said roll housing, supporting both adjacent ends of one vertical pair of beams, respectively, and being [coinfigured] *configured* in cross section perpendicular to said roll axes so as to include a central inwardly extending projection; the projection having its innermost surface engaging the outermost surface of both chocks for one end of both working rolls; a vertically extending portion parallel to, outwardly spaced from, and of greater vertical extent than said surface, with the horizontal portion of said central projection extending therebetween; and upper and lower projections extending inwardly from the uppermost and lowermost ends of said vertically extending portion to form respective recesses;

each beam having a configuration and cross section perpendicular to said axes so as to completely engage the inner surfaces of said bearing forming said recesses, and vertically extending portion and said central porjection, and further having a flat innermost surface coextensive with the innermost surface of said central projection and engaging with a respective chock of the respective working roll; and said roll benders including piston and cylinder means extending directly between respective beams and chocks for said working rolls.

13. A rolling mill comprising:

a roll housing;

a pair of parallel axis working rolls provided with metal chocks at the opposite axial ends;

a pair of parallel axis back-up rolls, mounted on said roll housing by metal chocks provided at the opposite axial ends, for supporting respective ones of said working rolls;

means operatively connected to said work rolls for adjusting the spacing between said working rolls and to bring the working rolls into contact with the material to be rolled;

two beams extending axially parallel to and on opposite sides of each of said working rolls; the opposite axial ends of each beam having means for supporting respective ones of said metal chocks for said working rolls, and including roll benders providing radial forces between each end of each of said beams and the adjacent chocks for bending said working rolls to control the contour of the material to be rolled;

means mounting the opposite axial ends of said beams on said roll housing for movement of said beams together with each of said working rolls and its associated chocks axially relative to said roll housing, and including four slide bearings in said housing, each respectively for the two adjacent ends of beams on the same side, said bearings each including a central projection extending between and engaging its adjacent beam ends *and further including upper and lower projections spaced vertically from said central projection each having recesses, such that said central projection and said recesses engage parts of said beams* so as to prevent any movement of said beam ends toward each other [to neutralize] *and said roll benders being positioned wholly within a*

*horizontally extending width of said central projection such that* the forces provided by said roll benders *are neutralized* and [permit] axial movement of said beams *is permitted* when said roll benders are actuated by opposing the force of one roll bender directly by the force of the adjacent roll bender on the other side of [their] *the respective* central projection; and independent actuator *cylinder* means *disposed in juxtaposition with said beams and* connected [between] *to* said housing and *directly to* said beams for driving said beams, said chocks and said roll benders for each working roll axially.

14. The rolling mill as defined in claim 13, wherein said rolls are vertically stacked, and said means supporting include said slide bearings symmetrically arranged in a horizontal plane passing through the gap between said working rolls, wherein the beams for the upper working roll are horizontally spaced apart and the beams for the lower working roll are horizontally spaced apart in opposed horizontal pairs and opposed vertical pairs symmetrical with respect to the gap between said working rolls;

each bearing being integral, rigidly mounted on said roll housing, supporting both adjacent ends of one vertical pair of beams, respectively, and being configured in cross section perpendicular to said roll axes so that said central projection has an inwardly extending T-shape; the *T-shaped central* projection having its innermost surface engaging the outermost surface of both chocks for one end of both working rolls; a vertically extending portion parallel to, outwardly spaced from, and of greater vertical extent than said surface, with the horizontal portion of said T-shaped central projection extending therebetween; [and] *said* upper and lower projections extending inwardly from the uppermost and lowermost ends of said vertically extending portion and then extending toward each other with small projections to form respective recesses;

each beam having a configuration and cross section perpendicular to said axes [to] *so* as to completely engage the inner surfaces of said bearing forming said recesses, said vertically extending portion and said T-shaped central projection, and further having a flat innermost surface coextensive with the innermost surface of said T-shaped *central* projection and engaging with a respective chock of the respective working roll; and said roll benders including piston and cylinder means extending directly between respective beams and chocks for said working rolls.

15. A rolling mill comprising:

a roll housing;

a pair of parallel axis working rolls provided with metal chocks at the opposite axial ends;

a pair of parallel axis back-up rolls, mounted on said roll housing by metal chocks provided at the opposite axial ends, for supporting respective ones of said working rolls;

means operatively connected to said work rolls for adjusting the spacing between said working rolls and to bring the working rolls into contact with the material to be rolled;

at least two *independent* beams extending axially parallel to, coplanar with and on opposite sides of one of side working rolls;

the opposite axial ends of each beam having means for supporting respective ones of said metal chocks for said one working roll, including a transverse slide bearing engagement between each chock and beam end providing movement of each chock relative to the beams on each side in a direction perpendicular to the plane;

said means for supporting including roll benders providing radial forces that are perpendicular to the plane and between said beams and chocks for producing said movement and thereby bending said one working roll to control the contour of the material to be rolled;

means mounting the opposite axial ends of said beams on said roll housing for movement of said beams together with said one working roll and its associated chocks axially relative to said roll housing, and including an axial slide bearing in said housing; *said axial slide bearing having a central projection extending horizontally and toward said chock, and said roll bender being disposed in said means for supporting in a region of said central projection;* independent actuator means *disposed in juxtaposition with said beam and* connected [between] *to* said housing and *directly to* said beams for driving said beams and one working roll axially, and thereby producing a moment in said beams that tends to bend one end of said beams together to clamp the chock between the beam ends with said transverse slide bearing engagement; and said axial slide bearing wrapping [aroung] *around* each beam so as to prevent bending movement of said beams in the plane to neutralize the moments provided by said actuator means and permit transverse slide bearing movement of said chocks relative to said beams along said transverse slide bearing engagement when both said actuator means and said roll benders are actuated.

* * * * *